US012576300B2

(12) United States Patent
Garcia

(10) Patent No.: US 12,576,300 B2
(45) Date of Patent: Mar. 17, 2026

(54) ASSISTED PLANCHE EXERCISE APPARATUS

(71) Applicant: Jacobo Garcia, El Paso, TX (US)

(72) Inventor: Jacobo Garcia, El Paso, TX (US)

( * ) Notice: Subject to any disclaimer, the term of this patent is extended or adjusted under 35 U.S.C. 154(b) by 195 days.

(21) Appl. No.: 18/363,749

(22) Filed: Aug. 2, 2023

(65) Prior Publication Data

US 2024/0399193 A1 Dec. 5, 2024

Related U.S. Application Data

(60) Provisional application No. 63/506,172, filed on Jun. 5, 2023.

(51) Int. Cl.
*A63B 21/00* (2006.01)

(52) U.S. Cl.
CPC ..... *A63B 21/156* (2013.01); *A63B 21/00065* (2013.01); *A63B 21/4011* (2015.10); *A63B 21/4031* (2015.10); *A63B 21/4045* (2015.10); *A63B 2225/09* (2013.01)

(58) Field of Classification Search
CPC ..... A63B 21/156; A63B 21/4011; A63B 21/4031; A63B 21/4045; A63B 21/00065
See application file for complete search history.

(56) References Cited

U.S. PATENT DOCUMENTS 4,714,247 A * 12/1987 Gerstung ..... A63B 23/1209 482/106
5,554,083 A * 9/1996 Chen ..... A63B 23/1254 482/138
6,702,724 B2 * 3/2004 Taylor ..... A63B 23/0405 482/52
11,173,337 B2 * 11/2021 Jones ..... A63B 21/06
11,219,793 B1 * 1/2022 Weiss ..... A63B 17/04
11,517,785 B1 * 12/2022 Nolan ..... A63B 17/04
11,896,867 B1 * 2/2024 Nolan ..... A63B 21/4027
2002/0098959 A1 * 7/2002 Florek ..... A63B 21/4045 482/141
2005/0003938 A1 * 1/2005 Henderson ..... A63B 23/1227 482/142
2005/0202941 A1 * 9/2005 Vaes ..... A63B 21/0628 482/94
2007/0275829 A1 * 11/2007 Popescu ..... A63B 21/0628 482/37

* cited by examiner

*Primary Examiner* — Joshua T Kennedy
(74) *Attorney, Agent, or Firm* — Jacobo Garcia

(57) ABSTRACT

An assisted planche exercise apparatus includes a frame including a top member that is attached to a first rail structure that guides a slidable first rolling assembly connected by pulley to a variable weight stack; the weight stack providing a counterweight force to the first rolling assembly. The first rolling assembly includes a second extending rail structure positioned approximately parallel to the ground, which guides a slidable second rolling assembly including a foot or leg support structure. The rail structures can include at least one hole capable of releasably receiving reversibly securable pins which limit the range of motion of the slidable rolling assemblies on the rails. The apparatus is designed to simulate the planche position and movement with minimal friction, while supporting a user's bodyweight throughout the planche movement and position. Moreover, the apparatus allows for the precise tracking of progressive overload to accomplish the planche position and movement.

12 Claims, 7 Drawing Sheets

ASSISTED PLANCHE EXERCISE APPARATUS

CROSS-REFERENCE TO RELATED APPLICATIONS

The application claims the benefit of U.S. Provisional Application No. 63/506,172, filed Jun. 5, 2023, which is incorporated herein by reference in its entirety for all purposes.

FIELD OF THE INVENTION

The invention relates generally to an assisted bodyweight exercise apparatus for performing the planche movement and position.

BACKGROUND

A planche is a gymnastics or calisthenics exercise and position where a person supports and balances their entire bodyweight on their hands. The planche is characterized by a person's lower body, as well as upper body, positioned in an elevated position horizontally parallel to the ground, with only the hands making contact with the ground. Performing a planche requires a high degree of balance, full-body strength, and range of motion, which makes it very difficult for the average person to perform. Moreover, in order to perform the planche, a person must know how to properly engage their muscles and skeletal frame to engage in the requisite leverages and counter-leverages for achieving the planche. Thus, the disclosed apparatus/apparatuses allow a user to adequately and seamlessly practice/simulate the planche motion, movement, position, and requisite strength in a manner that closely imitates the planche movement and position, including engaging the proper skeletal and musculature leverages and counter leverages, and in a manner that can precisely measure the progression of the above-mentioned variables.

BRIEF SUMMARY OF THE INVENTION

The invention herein describes an assisted planche exercise apparatus used to assist a user in practicing the planche position and movement, commonly performed in gymnastics and advanced calisthenics, by supporting the user's weight while guiding the user throughout the planche movement and position. The machine functions to assist the user throughout the planche by supporting some of the users weight via a counterweight connected to a pulley system providing a supportive force. By supporting a user's weight and guiding the user throughout the planche motion and position, the user is able to perform the planche and use the involved muscles for the planche at a fraction of the users true bodyweight, in addition to practicing the bodily motion, strength, skeletal and muscular engagements, and leverages involved in performing the planche. Thus, the invention will help people develop the strength and movement necessary to eventually perform an unassisted planche, or help people that can perform an unassisted planche practice the planche without their true bodyweight. Moreover, the apparatus allows a user to precisely progressively overload/advance for the planche movement and allows for the precise measurement of gradual increase in strength and movement through being able to precisely measure and control the predetermined counterweight amount and height of planche performance. This helps a user accomplish the unassisted planche more efficiently and in a shorter time-frame.

To use a version of the apparatus, a user selects an appropriate counterweight from the weight stack that will support part of their bodyweight, secures pins at a location above and below a first rolling assembly in order to limit the first rolling assembly's potential range of motion throughout the performance of the assisted planche, and the user places their feet or legs on top of a slidable foot or leg support included on the first rolling assembly while in a pushup-like position. The user then leans forward in the pushup-like position with their hands remaining in place while being continually supported by the slidable foot or leg support, accomplishing an assisted planche position and an assisted planche motion at a fraction of the user's unassisted bodyweight.

An embodiment of the apparatus includes a first rail structure positioned in a slanted sloping position that guides a reversibly slidable first rolling assembly including rollers along the first rail structure. The first rail structure includes at least one hole capable of releasably receiving a reversibly securable pin which limits the potential range of motion of the first rolling assembly along the first rail structure. The first rolling assembly further includes and supports an extending second rail structure that guides a reversibly slidable second rolling assembly including rollers and including a foot or leg support surface, along the length of the second rail structure. A cable traveling on pulleys or a pulley is connected at one end to the first rolling assembly guided by the first rail structure and at the other end connected to a variable weight stack that serves as a counterweight. Thus, the apparatus enables a user to accomplish the planche by supporting the user's weight via a counterweight. Moreover, the second rail structure includes a bumper mechanism which secures the second rolling assembly including a foot or leg support surface onto the second rail structure and prevents the second rolling assembly including a foot or leg support surface from detaching from the second rail structure. Moreover, the second rail structure can also include at least one hole capable of releasably receiving a reversibly securable pin which limits the potential range of motion of the second rolling assembly along the second rail structure. Thus, the apparatus allows counterweight-supported movement throughout the directions of the planche movement and position with minimal friction, as in an unassisted planche. Moreover, advancing/progress in such simulation of the planche movement and position can be precisely and accurately measured via the variable weight stack and maintaining the positions of the simulated planche.

In another embodiment, the first rail structure is positioned in a vertical position, perpendicular to the ground.

DETAILED DESCRIPTION OF THE INVENTION

Figure 1:
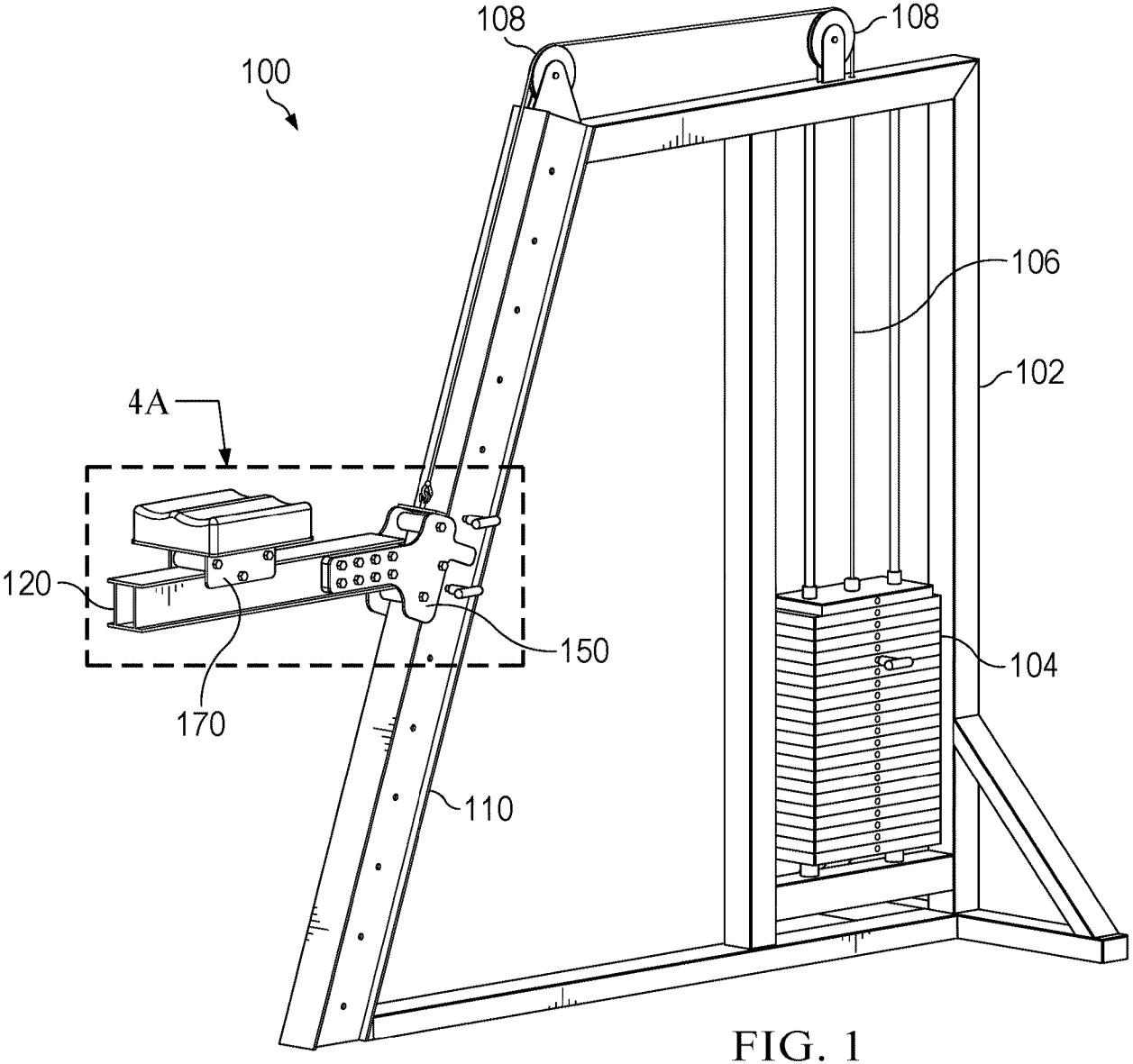
FIG. 1 shows an isometric view of an embodiment of the assisted planche exercise apparatus with a pin inserted into the first rail structure in an upper position and a second pin inserted into the first rail structure at a lower position. The illustration also labels the subject of the illustration of FIG. 4A.
Figure 2:
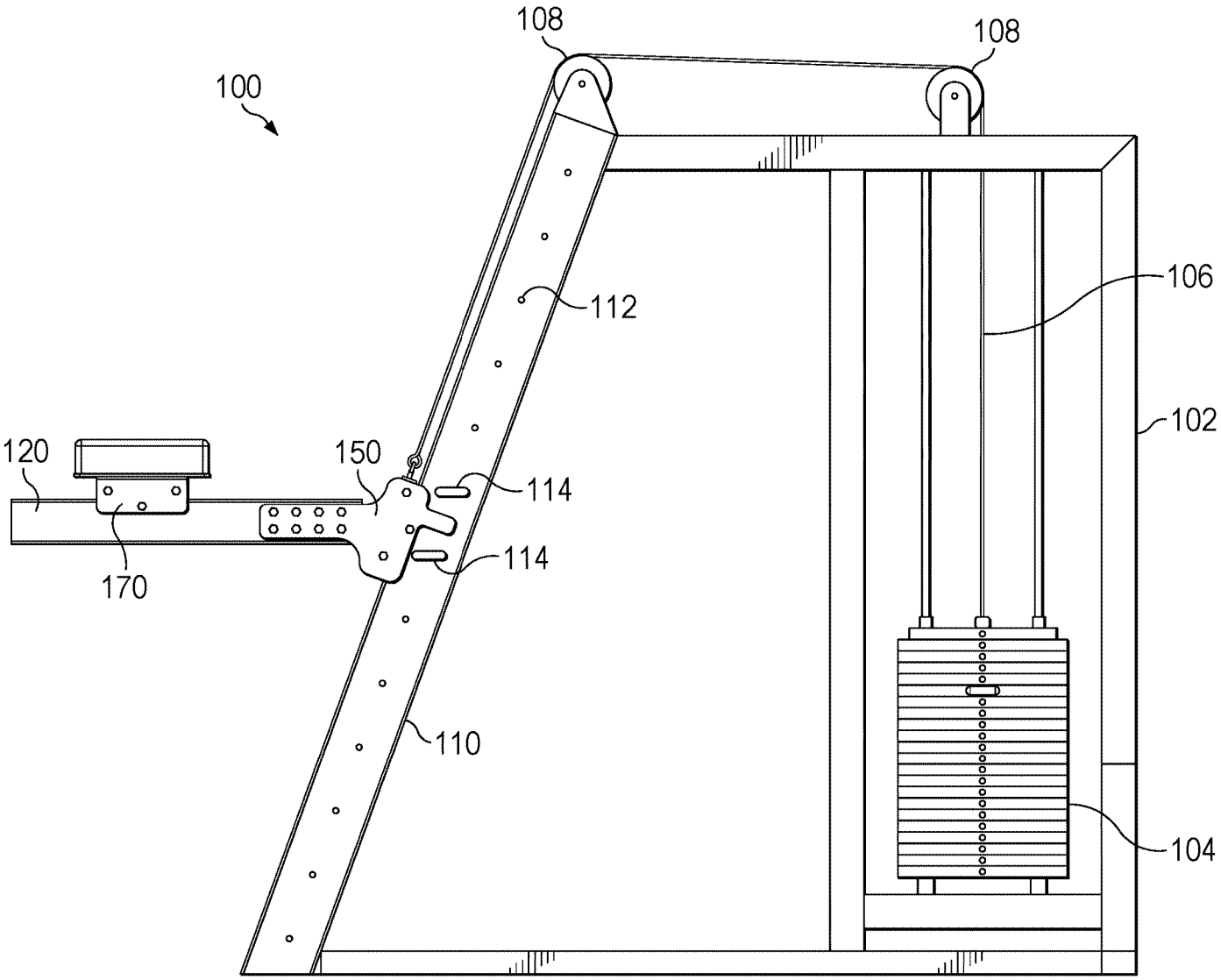
FIG. 2 shows a side view of the apparatus of FIG. 1.

Certain embodiments disclosed herein provide for an assisted planche exercise apparatus with a counterweight surface supporting a user's bodyweight along the directions of the planche movement and position via rolling assemblies guided by operatively connected rail structures enabling multi-directional movement simulating the planche motion, positioning, leverages, and strength.

After reading this description it will become apparent to one skilled in the art how to implement the invention in various alternative embodiments. However, although various embodiments of the present invention will be described herein, it is understood that these embodiments are presented by way of example only, and not limitation.

As illustrated in the example embodiment of FIGS. 1-5, an embodiment of the assisted planche exercise apparatus 100 includes a base making contact with the ground that supports a weight stack 104, and a frame 102 that includes an elevated beam member attached to a first rail structure 110, the elevated beam member including a pulley 108 and the top of the first rail structure 110 including a second pulley 108. However, it should be noted that the number of pulleys included can be varied to be greater or lower in each of the respective structures including a pulley. For example, two or three pulleys could be included on the elevated beam member, while no pulley is included on the top of the first rail structure 110. Moreover, it should also be noted that the slope of the first rail structure 110 can be any non-zero degree of positive or negative slope from the ground. Alternatively, the first rail structure 110 can be perpendicular from the ground. The base making contact with the ground may also be attached to the base of the first rail structure 110. The weight stack 104 is connected to a cable 106 traveling on a pulley or set pulleys 108 wherein the cable 106 is also connected to a reversibly slidable first rolling assembly 150 placed and connected onto the first rail structure 110, wherein the slidable first rolling assembly 150 reversibly slides along the first rail structure 110. In the example embodiment, the first rolling assembly 150 includes rollers 156*a*, 156*b*, 158*b*, 158*a* shown best in FIG. 4A, FIG. 4B, and FIG. 5 that reversibly slide the first rolling assembly 150 along the first rail structure 110 in the embodiment described. However, it should be noted that the number of rollers included in the first rolling assembly 150 can be greater or lower. The weight stack 104 serves as a counterweight to the first rolling assembly 150 via the cable 106, generating a positive upward supporting force, among other directional forces. Moreover, the weight stack 104 is a variable-weight weight stack that can be of adjustable weight. Moreover, the first rail structure 110 includes at least one hole 112 capable of releasably receiving a reversibly securable pin 114 which limits the potential range of motion of the first rolling assembly 150 in the direction shown by arrow 302 via an extended portion 154 of the first rolling assembly 150 making contact with the reversibly securable pins 114.

Moreover, the first rolling assembly 150 includes and supports an extending second rail structure 120 that guides a reversibly slidable second rolling assembly 170 including a foot or leg support surface 180. Note that the extending second rail structure can be extending in a horizontal position parallel to the ground or in any approximately-horizontal position from the ground in alternative embodiments. In the example embodiment, the slidable second rolling assembly 170 includes rollers 176*a*, 176*b*, 178*b*, 178*a* that reversibly slide the slidable second rolling assembly 170 and foot or leg support surface 180 along the second rail structure 120. However, it should be noted that the number of rollers included in the slidable second rolling assembly 170 can be greater or lower. Moreover, the second rail structure 120 can include an elevated surface bumper (not illustrated) extending from the surface of the second rail structure 120 that limits the potential range of motion of the slidable second rolling assembly 170 along the second rail structure 120, including to prevent the second rolling assembly 170 and foot or leg support surface 180 from detaching from the second rail structure 120. For example, this can be a reversibly securable pin or an elevated surface. Additionally, the second rail structure 120 can include at least one hole capable of releasably receiving a reversibly securable pin, as with the first rail structure, either in addition to the elevated surface bumper or as a substitute to the described elevated surface bumper.

Figure 3:
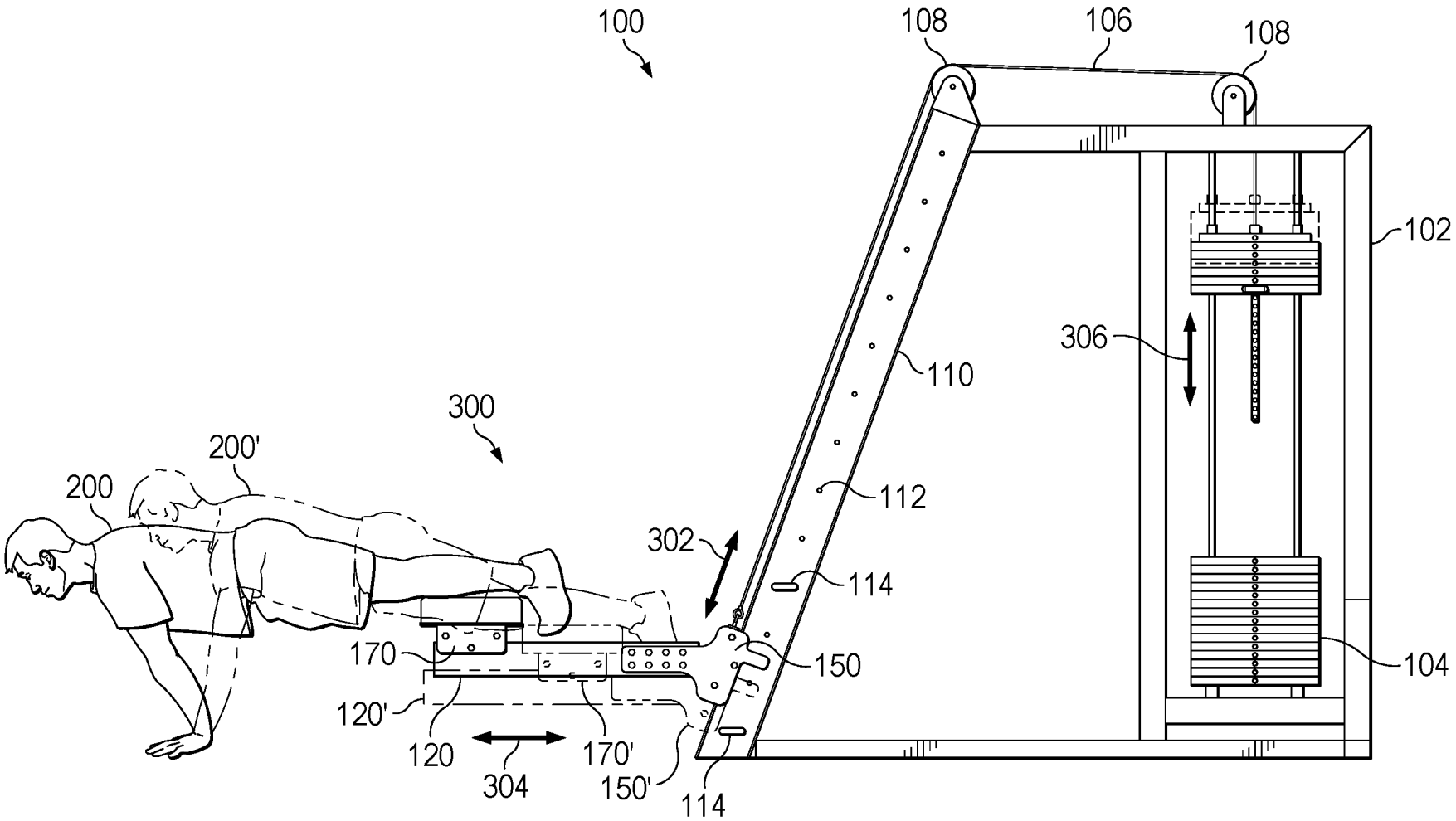
FIG. 3 shows a side view of the apparatus of FIGS. 1 and 2 in use, with a user in an initial start position ready to perform the assisted planche and in an end position performing the assisted planche.
Figure 4A:
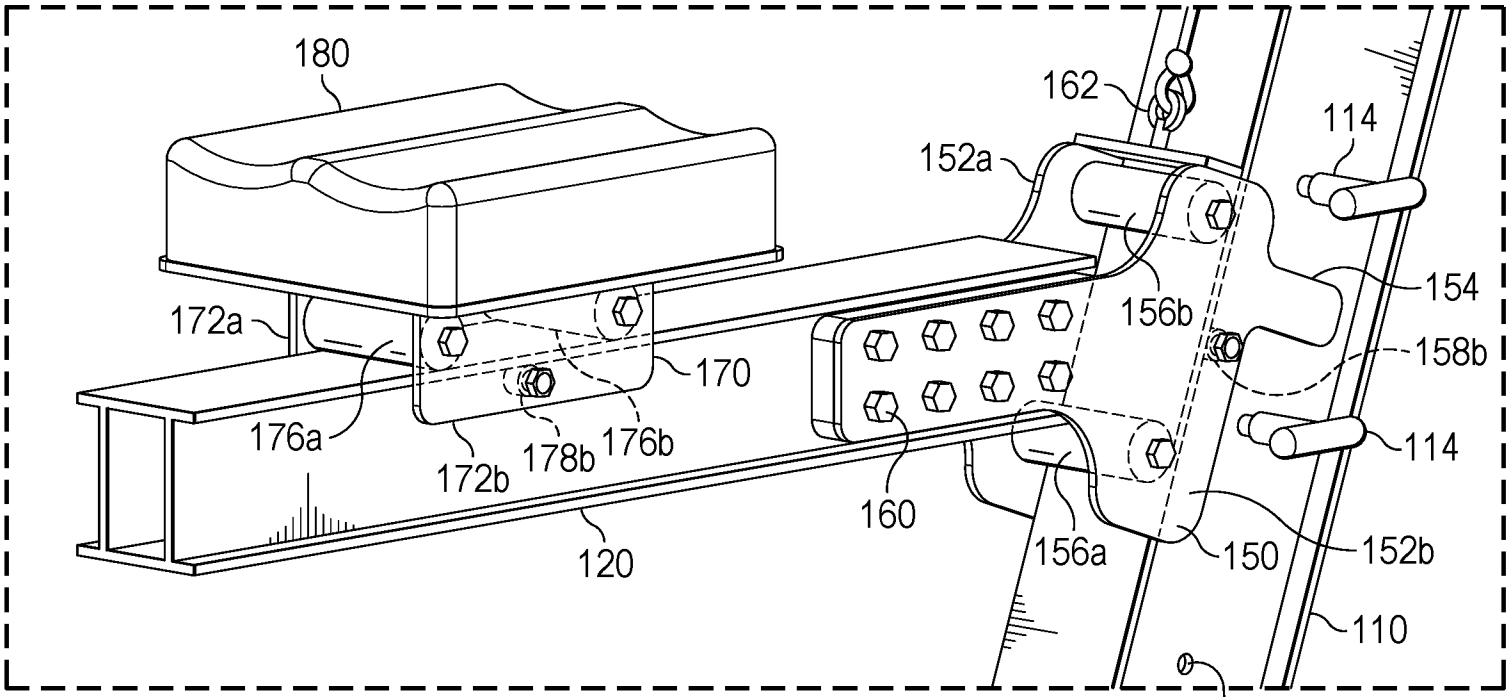
FIG. 4A shows a detailed view of an enlarged portion of FIGS. 1-2.
Figure 4B:
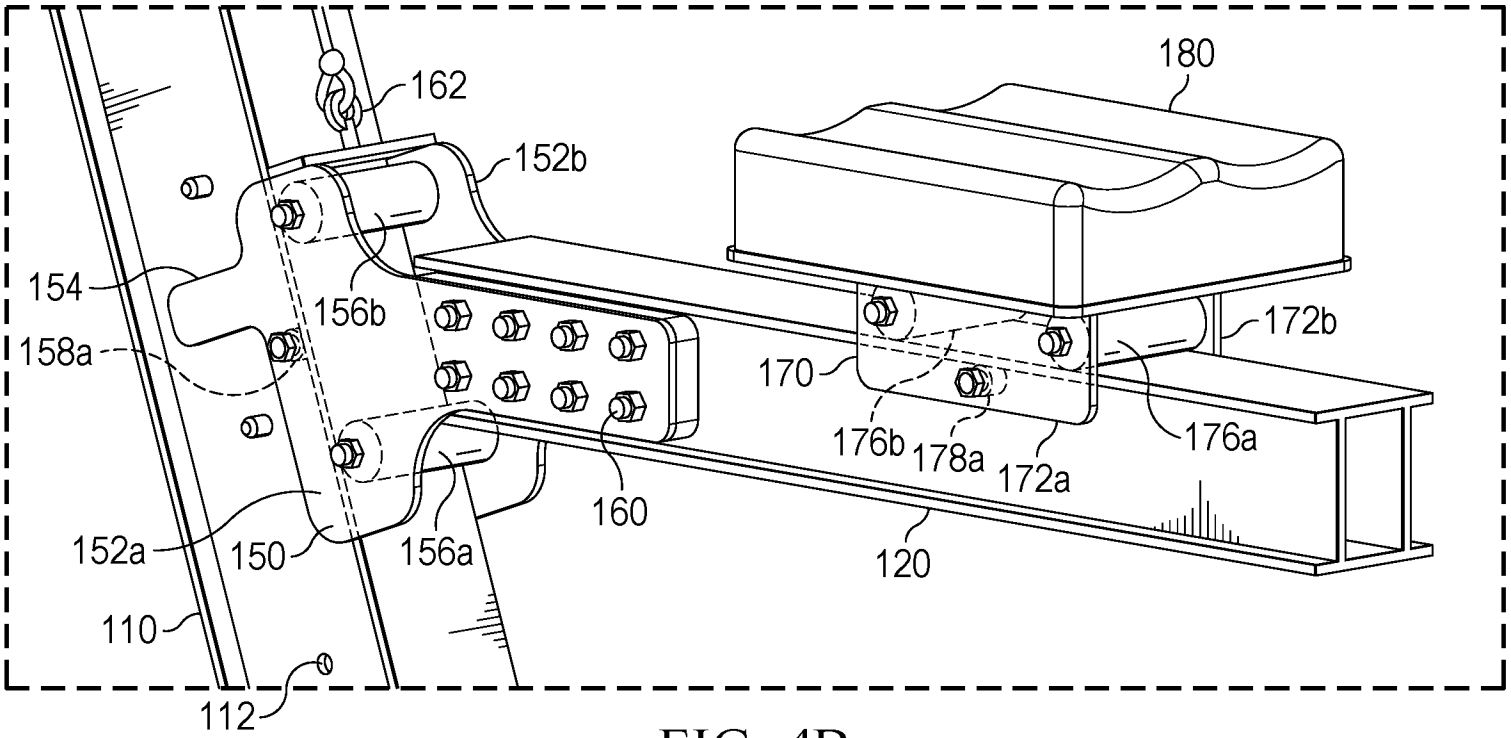
FIG. 4B shows a detailed view of the opposite side of FIG. 4A.
Figure 5:
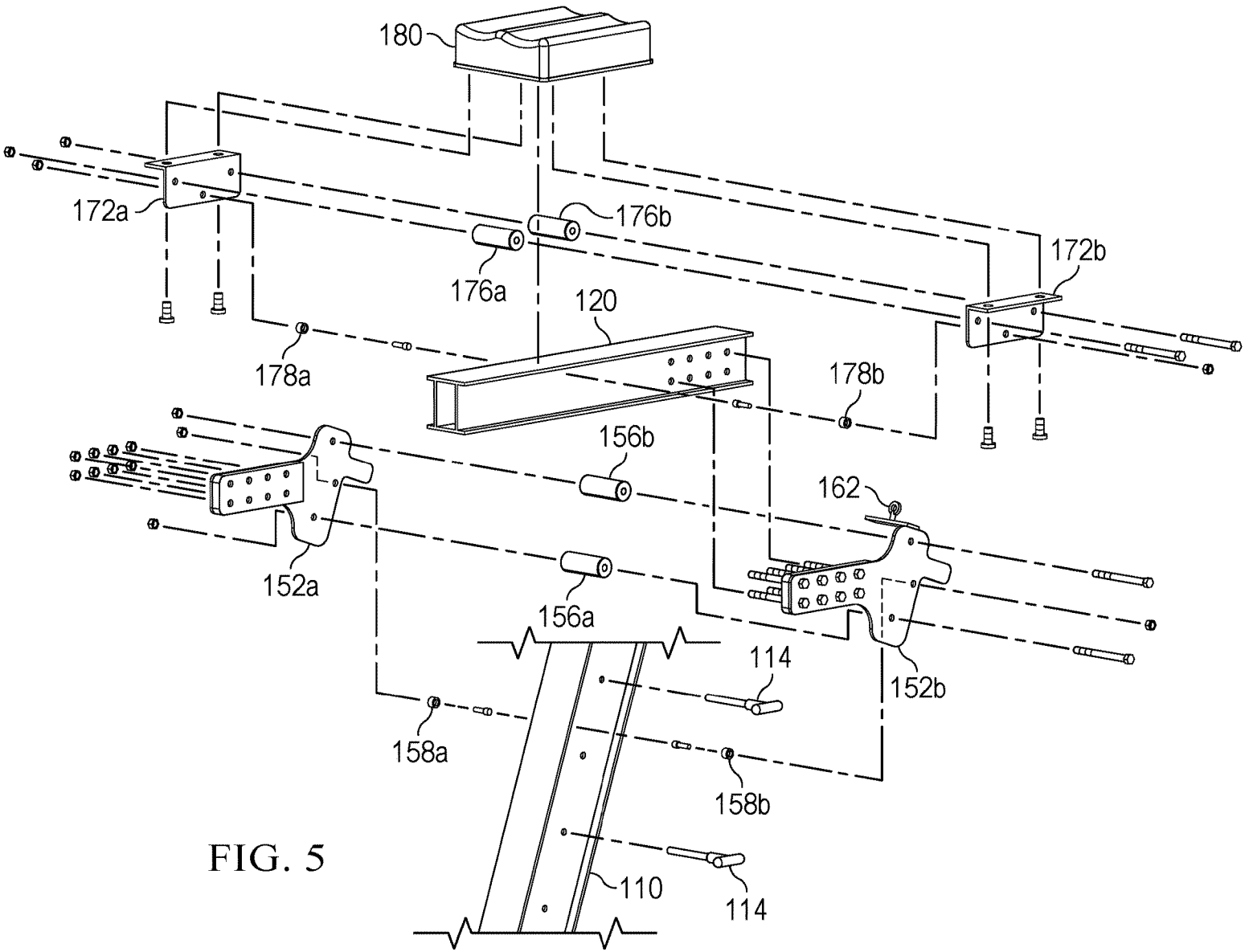
FIG. 5 shows an exploded view of the apparatus rail structures, rolling assemblies, rollers, and pins of the embodiment of FIGS. 1-4B.

FIG. 3 illustrates a user of an embodiment of the exercise apparatus 100 shown in FIGS. 1-5. A user starts in a position similar to that of a push-up 200' with their legs and feet supported by the foot or leg support surface included on the slidable second rolling assembly 170'. Then a user transitions into the final position 200 by leaning forward while being continuously supported by the foot or leg support surface which moves along with the user (as shown by arrow 304). Moreover, FIG. 3 illustrates an initial position of the slidable first rolling assembly 150' and the slidable second rolling assembly 170' as a user is in a start position 200'. In addition, FIG. 3 illustrates an end position of the slidable first rolling assembly 150 and the slidable second rolling assembly 170 as a user is in the final position 200.

Figure 6:
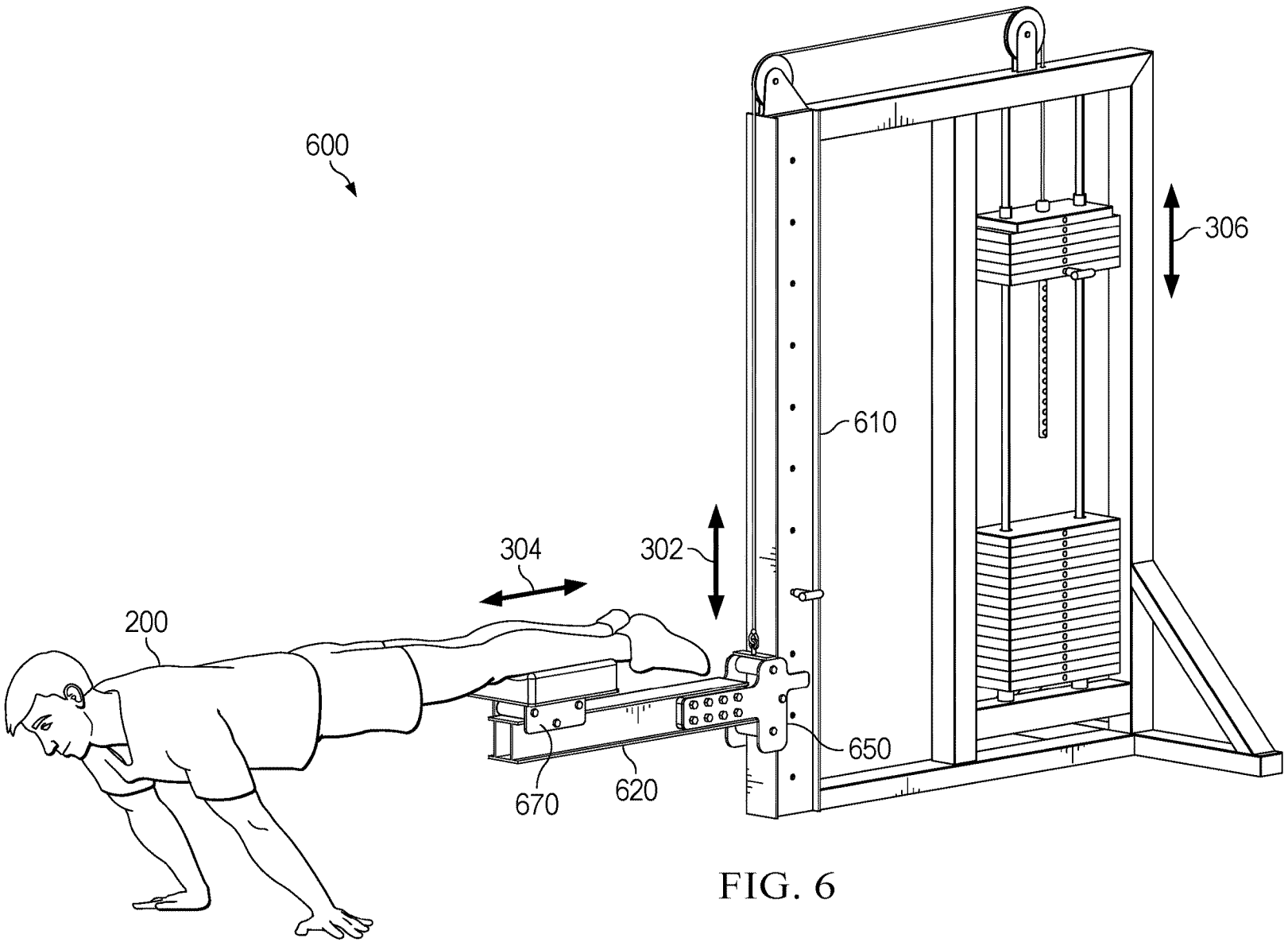
FIG. 6 shows a isometric view of a second embodiment of the assisted planche exercise apparatus with an upright vertical first rail structure and a user performing the final position of the assisted planche.

FIG. 6 illustrates a user in a final position 200 of the assisted planche exercise using an alternative embodiment of the exercise apparatus that includes the first rail structure 610 in a vertical position, perpendicular to the ground.

The above description of the disclosed embodiments is provided to enable any person skilled in the art to make or use the invention. Various modifications to these embodiments will be readily apparent to those skilled in the art, and the generic principles described herein can be applied to other embodiments. Thus, it is to be understood that the description and drawings presented herein represent presently preferred embodiments of the invention and are therefore representative of the subject matter which is broadly contemplated by the present invention.

What is claimed is:

1. An assisted exercise apparatus, comprising:

a frame including an elevated beam member;

a first rail structure attached to the elevated beam member, wherein the first rail structure is extending downward, and wherein the first rail structure includes at least one hole for releasably receiving a reversibly securable pin;

a reversibly slidable first rolling assembly operatively connected to the first rail structure, wherein the reversibly slidable first rolling assembly slides along the first rail structure;

a second rail structure attached to the first rolling assembly and extending in a horizontal position parallel to the ground or approximately parallel to the ground, wherein the second rail structure includes a surface bumper and at least one hole for releasably receiving a reversibly securable pin;

a second roller assembly supporting a foot or leg support surface and configured to roll along the second rail structure; and a cable pulley system of at least one pulley connecting the reversibly slidable first rolling assembly to a counterweight system which applies a counterweight force to the reversibly slidable first rolling assembly and thereby the attached second rail structure and the second roller assembly supporting the foot or leg support surface.

2. The assisted exercise apparatus of claim 1, wherein the first rail structure is angled at a positive or negative sloping position from the ground, wherein the slope is non-zero.

3. The assisted exercise apparatus of claim 1, wherein the first rail structure is positioned perpendicularly from the ground.

4. An assisted exercise apparatus, comprising a frame including an elevated beam member;

a first rail structure attached to the elevated beam member, wherein the first rail structure is extending downward, and wherein the first rail structure includes at least one hole for releasably receiving a reversibly securable pin;

a reversibly slidable first rolling assembly operatively connected to the first rail structure, wherein the reversibly slidable first rolling assembly slides along the first rail structure;

a second rail structure attached to the first rolling assembly and extending in a horizontal position parallel to the ground or approximately parallel to the ground, wherein the second rail structure includes a surface bumper;

a second roller assembly supporting a foot or leg support surface and configured to roll along the second rail structure; and a cable pulley system of at least one pulley connecting the reversibly slidable first rolling assembly to a counterweight system which applies a counterweight force to the reversibly slidable first rolling assembly and thereby the attached second rail structure and the second roller assembly supporting the foot or leg support surface.

5. The assisted exercise apparatus of claim 4, wherein the first rail structure is angled at a positive or negative sloping position from the ground, wherein the slope is non-zero.

6. The assisted exercise apparatus of claim 4, wherein the first rail structure is positioned perpendicularly from the ground.

7. A An assisted exercise apparatus, comprising a frame including an elevated beam member;

a first rail structure attached to the elevated beam member wherein the first rail structure is extending downward;

a reversibly slidable first rolling assembly operatively connected to the first rail structure, wherein the reversibly slidable first rolling assembly slides along the first rail structure;

a second rail structure attached to the first rolling assembly and extending in a horizontal position parallel to the ground or approximately parallel to the ground;

a second roller assembly supporting a foot or leg support surface and configured to roll along the second rail structure; and a cable pulley system of at least one pulley connecting the reversibly slidable first rolling assembly to a counterweight system which applies a counterweight force to the reversibly slidable first rolling assembly and thereby the attached second rail structure and the second roller assembly supporting the foot or leg support surface.

8. The assisted exercise apparatus of claim 7, wherein the first rail structure is angled at a positive or negative sloping position from the ground, wherein the slope is non-zero.

9. The assisted exercise apparatus of claim 7, wherein the first rail structure is positioned perpendicularly from the ground.

10. A An assisted exercise apparatus, comprising a frame including an elevated beam member;

a first rail structure attached to the elevated beam member, wherein the first rail structure is extending downward, and wherein the first rail structure includes at least one hole for releasably receiving a reversibly securable pin;

a reversibly slidable first rolling assembly operatively connected to the first rail structure, wherein the reversibly slidable first rolling assembly slides along the first rail structure;

a second rail structure attached to the first rolling assembly and extending in a horizontal position parallel to the ground or approximately parallel to the ground, wherein the second rail structure includes at least one hole for releasably receiving a reversibly securable pin;

a second roller assembly supporting a foot or leg support surface and configured to roll along the second rail structure; and a cable pulley system of at least one pulley connecting the reversibly slidable first rolling assembly to a counterweight system which applies a counterweight force to the reversibly slidable first rolling assembly and thereby the attached second rail structure and the second roller assembly supporting the foot or leg support surface.

11. The assisted exercise apparatus of claim 10, wherein the first rail structure is angled at a positive or negative sloping position from the ground, wherein the slope is non-zero.

12. The assisted exercise apparatus of claim 10, wherein the first rail structure is positioned perpendicularly from the ground.

* * * * *